United States Patent [19]

Verne

[11] 3,962,517

[45] June 8, 1976

[54] ELECTRIC CABLES

[75] Inventor: Stefan Verne, London, England

[73] Assignee: BICC Limited, London, England

[22] Filed: June 12, 1974

[21] Appl. No.: 478,623

[52] U.S. Cl. ..... 428/383; 156/51; 156/247; 174/120 SC; 174/120 SR; 427/118

[51] Int. Cl.[2] ..... H01B 9/02; H01B 13/14

[58] Field of Search ..... 117/218, 216, 232; 156/51, 247; 174/120 SC, 120 SR, 120 AR; 427/118; 428/383

[56] References Cited

UNITED STATES PATENTS

| | | | |
|---|---|---|---|
| 3,617,377 | 11/1971 | Isshiki et al. | 117/232 X |
| 3,684,821 | 8/1972 | Miyauchi et al. | 117/232 X |
| 3,719,769 | 3/1973 | Miyauchi et al. | 174/120 SC |
| 3,769,085 | 10/1973 | Matsubara | 117/218 X |
| 3,787,255 | 1/1974 | Carini et al. | 117/232 X |
| 3,793,476 | 2/1974 | Misiura et al. | 174/120 SC |

*Primary Examiner*—Ralph Husack
*Attorney, Agent, or Firm*—Buell, Blenko, & Ziesenheim

[57] ABSTRACT

A cable core and method of forming such core is provided including a conductor having an extruded dielectric of an insulating material selected from the group of insulating materials consisting of rubber and plastics materials, a dielectric screen comprising a layer of conductive or semi-conductive material selected from the group consisting of conductive and semi-conductive rubber and plastics materials and, interposed between and bonded to the extruded dielectric and the dielectric screen throughout substantially the whole length of the core, an intermediate layer having at least in a circumferentially continuous zone of the layer a cohesive strength substantially less than the cohesive strengths of the extruded dielectric and the dielectric screen and substantially less than the strengths of the bonds between the intermediate layer and the dielectric screen such that when stripping the dielectric screen from the core over a part of its length for jointing or terminating purposes separation takes place within the intermediate layer to leave a portion of the intermediate layer on the extruded dielectric.

21 Claims, 1 Drawing Figure

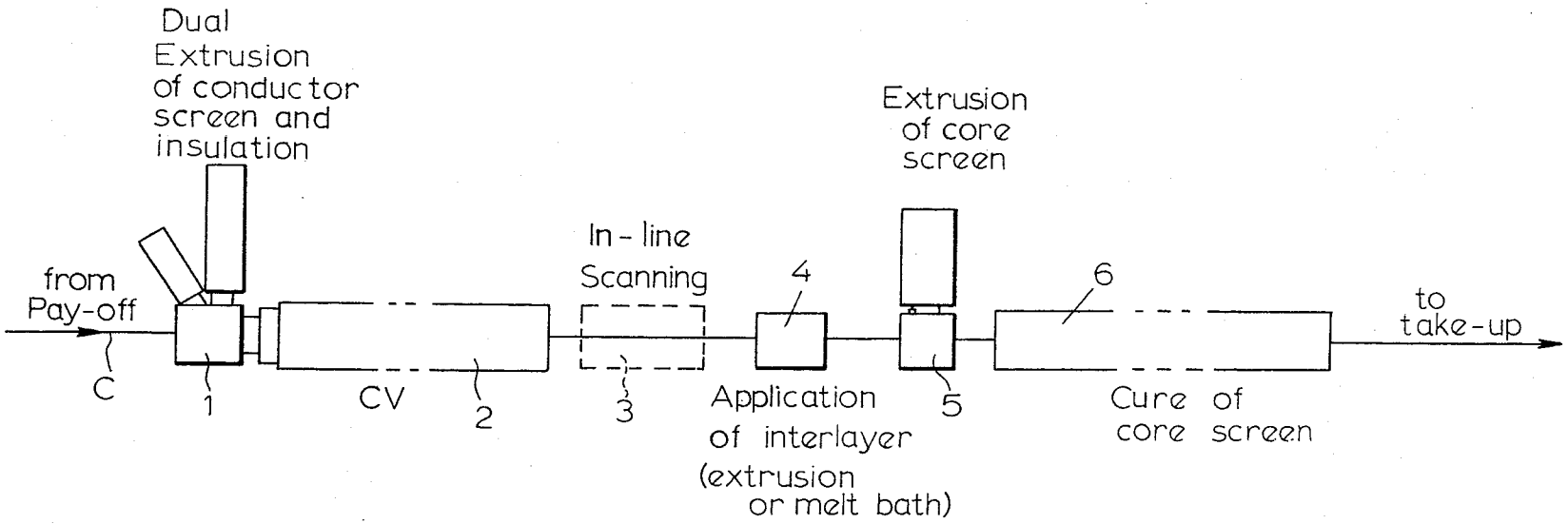
from
Pay-off
C
Dual
Extrusion
of conductor
screen and
insulation
1
CV
2
In-line
Scanning
3
4
Application
of interlayer
(extrusion
or melt bath)
Extrusion
of core
screen
5
6
Cure of
core screen
to
take-up

ELECTRIC CABLES

BACKGROUND OF THE INVENTION

This invention relates to single and multi-core electric cables and is particularly concerned with cores for such electric cables having an extruded dielectric of inuslating material to the outer surface of which is applied a conductive or semi-conductive layer constituting a dielectric screen. Examples of insulating materials of which the core dielectric may be made include natural rubber compositions, synthetic rubber-like compositions such as butyl rubber, ethylene/propylene rubber, silicone rubber and styrene butadiene rubber and synthetic plastics materials such as olefin polymers, for example ordinary or cross-linked polyethylene, and olefin copolymers, for example of ethylene and propylene, all such materials hereinafter for convenience being included in the generic expression "rubber or plastics material".

In order to prevent the formation of spaces between a core dielectric and the dielectric screen in which electrical discharges can take place it is desirable that the dielectric screen should fit tightly on the core dielectric and with this purpose in view it has been proposed to form the dielectric screen of a cable core having an extruded dielectric of rubber or plastics material by extruding about the core dielectric a layer of rubber or plastics material rendered electrically conductive by the incorporation of suitable additives, the extrusion of the dielectric screen being effected in such a way and the materials being such that, throughout its length, the extruded dielectric screen bonds firmly to the core dielectric. Whilst such a firm bond is highly desirable from an electrical point of view it has the disadvantage that, when jointing or terminating a cable incorporating a screened core of this form, it is difficult to cut back and strip the extruded dielectric screen cleanly from the core dielectric.

It is an object of the present invention to provide an improved cable core having a dielectric screen which can be easily removed for jointing or terminating purposes.

SUMMARY OF THE INVENTION

According to the invention the cable core comprises a conductor having an extruded dielectric of rubber or plastics material, a dielectric screen comprising a layer of conductive or semi-conductive rubber or plastics material and, interposed between and bonded to the extruded dielectric and the dielectric screen throughout substantially the whole length of the core, an intermediate layer of rubber or plastics insulating material, the intermediate layer having throughout the layer or at least in a circumferentially continuous zone of the layer a cohesive strength substantially less than the cohesive strengths of the extruded dielectric and the dielectric screen and substantially less than the strengths of the bonds between the intermediate layer and the extruded dielectric and between the intermediate layer and the dielectric screen such that when stripping the dielectric screen from the core over a part of its length for jointing or terminating purposes separation takes place within the intermediate layer to leave a portion of the intermediate layer on the extruded dielectric.

Preferably the cohesive strength of the intermediate layer is not greater than 70% (and preferably not greater than 50%) of the cohesive strength of the dielectric or the screen, whichever is weaker, and preferably also it is at least about 5% of the latter cohesive strength. These relations should hold good throughout the range of temperatures from the lowest ambient temperature at which jointing of the cable may need to be carried out up to the maximum working temperature at the interface between the dielectric and the intermediate layer.

Preferably the intermediate layer is substantially thinner than the dielectric screen, and ideally as thin as possible, subject to maintaining a substantially continuous layer; in practice the ratio between the radial thicknesses of the intermediate layer and the dielectric screen if preferably in the range 1:2 to 1:20. The intermediate layer may be applied by causing a conductor having an extruded dielectric to pass through a bath of rubber or plastics insulating material in a viscous or fluid state but the intermediate layer is preferably applied by extrusion.

The invention also includes a method of forming a cable core in accordance with the invention which comprises extruding a layer of rubber or plastics insulating material on to a travelling conductor, which may or may not have a conductor screen applied thereto, to form the core dielectric; applying an intermediate layer of rubber or plastics insulating material to the outer surface of the core dielectric in such a way that the intermediate layer bonds to or can be subsequently bonded to, the core dielectric; and applying a layer of conductive or semi-conductive rubber or plastics material to the outer surfaces of the intermediate layer in such a way that the dielectric screen so formed bonds to, or can be subsequently bonded to the intermediate layer, the strengths of the bonds between the intermediate layer and the core dielectric and between the intermediate layer and the dielectric screen being substantially greater than the cohesive strength of the intermediate layer throughout the layer or at least in a circumferentially continuous zone of the layer, and the intermediate layer having, in the final product, a cohesive strength less than the cohesive strengths of the core dielectric and of the dielectric screen.

Preferably both the intermediate layer and the layer of conductive or semi-conductive rubber or plastics material constituting the dielectric screen are applied by extrusion and to obtain a firm bond between the intermediate layer and the core dielectric and between the intermediate layer and the extruded dielectric screen, the intermediate layer and dielectric screen respectively are preferably extruded while the core dielectric and intermediate layer are still hot. With this view in mind and with a view to maintaining as low as possible the additional cost incurred due to the provision of the intermediate layer, the core dielectric, intermediate layer and dielectric screen are preferably extruded on to a travelling conductor successively in line. Where a conductor screen is to be provided, preferably the conductor screen is an extruded layer of conductive or semi-conductive rubber or plastics material, the conductor screen and core dielectric preferably being extruded simultaneously in the same extrusion head.

DESCRIPTION OF MATERIALS USED

Examples of rubber or plastics materials for the intermediate layer that can be applied by extrusion include ethylene/propylene rubber based compounds, with or without fillers and with or without curing agent added.

Preferred ethylene/propylene rubber based compounds are set out in Table 1.

Table 1

| COMPOUND NO. | PARTS BY WEIGHT 1 | 2 | 3 | 4 | 5 | 6 | 7 | 8 |
|---|---|---|---|---|---|---|---|---|
| Keltan 320 | 50 | 60 | 50 | 60 | 50 | 60 | 50 | 60 |
| Elvax 250 | 50 | 40 | — | — | 50 | 40 | — | — |
| Elvax 460 | — | — | 50 | 40 | — | — | 50 | 40 |
| M100 Clay | — | — | — | — | 100 | 100 | 100 | 100 |
| Silane A-172 | — | — | — | — | 2 | 2 | 2 | 2 |

Keltan 320 is a low Mooney viscosity ethylene - propylene terpolymer rubber supplied by N. V. Nederlands & Staatsmijnen (DSM); Elvax 250 and 460 are grades of ethylene/vinyl acetate copolymer, supplied by E. I. Du Pont de Nemours & Co. The '250' grade contains 28% vinyl acetate, while the '460' grade is of higher molecular weight and contains 18% of vinyl acetate. M100 is calcined clay filler supplied by English China Clays Ltd. Silane A-172 is vinyl tris (beta methoxy ethoxy) silane, supplied by Union Carbide Corp.

Examples of rubber or plastics materials for the intermediate layer than can be applied by passing an insulated conductor through a bath of the material in a viscous or fluid state include blends of ethylene/vinyl acetate copolymers with synthetic resins.

Mixtures of low-Mooney ethylene/propylene rubber (keltan 320) and an ethylene/vinyl acetate copolymer, with the fillers, both with and without curing agent added, have been tested for use as an intermediate layer between moulded sheets of dielectric material and semi-conductive material based both on an ethylene/propylene rubber and on crosslinked polyethylene. It was found that both with the cured and with the uncured mixture used for the intermediate layer a good bond was obtained with dielectric material and semi-conductive material of both ethylene/propylene rubber and crosslinked polyethylene. To test the cohesive strength of the intermediate layers strips 25 mm wide were cut from moulded composite sheets, having dielectric and semi-conductive laminar each about 1mm thick and an interposed layer about 0.1 mm thick. The semi-conductive layer was peeled from the dielectric layer of each strip and the force required was in all cases found to be below about 150 Newtons, which force is within the range of strengths capable of separation by hand. After stripping each strip it was found that a portion of te intermediate layer remained bonded to the dielectric layer and a portion of the intermediate layer remained bonded to the semi-conductive layer, thereby indicating that separation occurred within the intermediate layer.

In the experiments described, the ethylene/propylene rubber based insulation and screen compounds were as set out in Table 2.

Table 2

| | EPR Compound 'A' (Insulation) | EPR Compound 'B' (Screen) |
|---|---|---|
| Intolan 255 | 85 | — |
| Vistalon 404 | — | 100 |
| Alkathene WVG 23 | 15 | — |
| Vulcan XC72 Black | — | 65.14 |
| Sunpar Oil 2280 | 31 | — |
| Esso D Process Oil | — | 13.48 |
| M100 Clay | 153 | — |
| Zinc Oxide | 5 | 5.40 |
| Flectol H | 2 | 0.54 |
| Antioxidant MB | 2 | — |
| Silane A-172 | 3.1 | — |
| Paraffin Wax | — | 5.40 |

Table 2-continued

| | EPR Compound 'A' (Insulation) | EPR Compound 'B' (Screen) |
|---|---|---|
| Sulphur | 0.3 | 0.32 |
| Retilox F.40 | 7.87 | 7.72 |

Intolan 255 is a high green strength ethylene propylene terpolymer rubber, supplied by International Synthetic Rubber Co., Vistalon 404 is an ethylene propylene copolymer rubber, supplied by Esso Chemicals Ltd.

Vulcan XC72 is a conductive grade of furnace carbon black supplied by Cabot Corporation.

Sunpar Oil 2280 is a low-aromatic (paraffinic) oil supplied by Sun Oil Co.,

Flectol H is an antioxidant, polymerised trimethyldihydroxyquinoline, supplied by Monsanto Co., Antioxidant MB is 2-mercaptobenzimidazole supplied by Farbenfabriken Bayer A.G.

Retilox F.40 is the $\alpha$ - $\alpha'$ bis-ter-butyl peroxide of m-p di-iso propylbenzene (40% active), supplied by Joseph Weil & Co., Ltd., (Montecatini)

Cross-linkable polyethylene compounds sold by Bakelite-Xylonite Ltd., under the designations HFDG 4360 and DPN 227 were used for insulation and screen respectively.

In the moulding of the sheets, aluminum foils were inserted in place of part of the intermediate layer to provide un-bonded gripping areas, and the peel strength was measured by a method substantially in accordance with British Standard 903 Part 31:1950 using an Instron Universal testing machine with a grip separation rate of 50 mm/minute. The load was continuously recorded and average (for each of several samples) was determined using a planimeter. Results were as shown in Table 3.

Table 3

| OUTER LAYERS COMPOUND NO. (INTERMEDIATE LAYER) | EPR COMPOUNDS A & B PEEL STRENGTH (N) 23°C | 80°C | BAKELITE HFDG 4360 and DPN 227 PEEL STRENGTH (N) 23°C | 80°C |
|---|---|---|---|---|
| 1 | 22.0 | 1.8 | 69.2 | 6.0 |
| 2 | 20.6 1.7 | 66.4 | 6.5 | |
| 3 | 71.4 | 4.4 | 112.8 | 9.3 |
| 4 | 56.9 | 10.5 | 79.0 | 7.3 |
| 5 | 114.8 | 14.7 | 138.8 | 21.6 |
| 6 | 111.0 | 38.3 | 134.9 | 19.4 |
| 7 | 114.4 | 21.7 | 147.6 | 23.8 |
| 8 | 107.5 | 25.0 | 138.3 | 16.9 |

The tests with the samples at 80°C showed a permanent bond between the intermediate layer and the dielectric layer and between the intermediate layer and the semi-conductive layer with a reduction in the cohesive strength of the intermediate layers of the composite sheets to about 10–35% of the value at 23°C.

BRIEF DESCRIPTION OF THE DRAWING

The invention is further illustrated by a description, by way of example, of a preferred method of forming a cable core of the present invention with reference to the accompanying drawing which illustrates diagrammatically the apparatus employed.

DESCRIPTION OF THE PREFERRED METHOD OF MANUFACTURE

In using the apparatus shown in the drawing to form a cable core a conductor C is passed through a dual extrusion head 1 where a layer of semi-conducting ethylene/propylene rubber based compound of radial thickness 1 mm and a layer of insulating ethylene/propylene rubber based compound of a radial thickness 5 mm are extruded simultaneously on to the conductor and are subsequently cured by passing through a treatment chamber 2. After passing through an in-line scanner 3 which locates any voids in the core dielectric the covered conductor passes through an extruder 4 which applies a thin intermediate layer of the insulating material specified above by way of example, the intermediate layer having a radial thickness of 0.1 mm. The covered conductor subsequently passes through an extruder 5 which applies a layer of semi-conductive ethylene/propylene rubber based compound to a radial thickness of 1 mm, the dielectric screen so formed being cured by passage through a treatment chamber 6; because of diffusion effects, the intermediate layer is also at least partially cured by this treatment.

In cases where in-line scanning is not required, the first curing step in treatment chamber 2 can usually be omitted, all layers being cured in the chamber 6, and this may significantly reduce expense.

The intermediate layer is bonded both to the dielectric and to the dielectric screen, the strengths of the bonds being substantially greater than the cohesive strength of at least a substantially central peripherally continuous zone of the intermediate layer.

What I claim as my invention is:

1. A cable core comprising a conductor having an extruded dielectric of an insulating material selected from the group of insulating materials consisting of rubber and plastics materials, a dielectric screen comprising a layer of conductive or semi-conductive material selected from the group consisting of conductive and semi-conductive rubber and plastics materials and, interposed between and bonded to the extruded dielectric and the dielectric screen throughout substantially the whole length of the core, an intermediate layer having at least in a circumferentially continuous zone of the layer a cohesive strength substantially less than the cohesive strengths of the extruded dielectric and the dielectric screen and substantially less than the strengths of the bonds between the intermediate layer and the extruded dielectric and between the intermediate layer and the dielectric screen such that when stripping the dielectric screen from the core over a part of its length for jointing or terminating purposes separation takes place within the intermediate layer to leave a portion of the intermediate layer on the extruded dielectric.

2. A cable core as claimed in claim 1 in which the intermediate layer has a cohesive strength substantially less than the cohesive strengths of the extruded dielectric and the dielectric screen and substantially less than the strengths of the bonds between the intermediate layer and the dielectric screen throughout the layer.

3. A cable core as claimed in claim 1 in which the extruded dielectric and the dielectric screen are based on ethylene/propylene rubber.

4. A cable core as claimed in claim 1 in which the extruded dielectric and the dielectric screen are based on cross-linked polyethylene.

5. A cable core as claimed in claim 1 in which the said intermediate layer is of an ethylene/propylene rubber based compound.

6. A cable core as claimed in claim 5 in which the said compound includes an ethylene/vinyl acetate copolymer.

7. A cable core as claimed in claim 5 in which the said compound includes a filler.

8. A cable core as claimed in claim 1 in which the intermediate layer has a cohesive strength in the range from about 5% to 70% of the cohesive strength of whichever of the dielectric and the dielectric screen is the weaker.

9. A cable core as claimed in claim 1 in which the intermediate layer has a cohesive strength in the range from about 5% to 50% of the cohesive strength of whichever of the dielectric and the dielectric screen is the weaker.

10. An electric power cable including at least one core as claimed in claim 1 and at least a surrounding protective sheath.

11. An electric power cable including at least one core as claimed in claim 1 and at least a surrounding protective sheath.

12. A cable core comprising a conductor having an extruded dielectric of an insulating material selected from the group of insulating materials consisting of rubber and plastics materials, a dielectric screen comprising a layer of conductive or semi-conductive material selected from the group consisting of conductive and semi-conductive rubber and plastics materials and, interposed between and bonded to the extruded dielectric and the dielectric screen throughout substantially the whole length of the core, an intermediate extruded layer of an insulating material selected from said group of insulating materials, the intermediate extruded layer having at least in a circumferentially continuous zone of the layer a cohesive strength substantially less than the cohesive strengths of the extruded dielectric and the dielectric screen and substantially less than the strengths of the bonds between the intermediate extrueded layer and the extruded dielectric and between the intermediate extruded layer and the dielectric screen such that when stripping the dielectric screen from the core over a part of its length for jointing or terminating purposes separation takes place within the intermediate layer to leave a portion of the intermediate layer on the extruded dielectric.

13. A cable core comprising a conductor having an extruded dielectric of an insulating material selected from the group of insulating materials consisting of rubber and plastics materials, a dielectric screen comprising a layer of conductive or semiconductive material selected from the group consisting of conductive and semi-conductive rubber and plastics materials and, interposed between and bonded to the extruded dielectric and the dielectric screen throughout substantially the whole length of the core, an intermediate extruded layer of an insulating material selected from said group of insulating materials, the intermediate extruded layer having a thickness in the range from ½ to 1/20 of the thickness of the dielectric screen and having at least in a circumferentially continuous zone of the layer a cohesive strength substantially less than the cohesive strengths of the extruded dielectric and the dielectric screen and substantially less than the strengths of the bonds between the intermediate extruded layer and the extruded dielectric and between the intermediate extruded layer and the dielectric screen such that when stripping the dielectric screen from the core over a part of its length for jointing or terminating purposes separation takes place within the intermediate layer to leave a portion of the intermediate layer on the extruded dielectric.

14. A method of forming a cable core comprising extruding a layer of an insulating material selected from the group of insulating materials consisting of rubber and plastics materials onto a travelling conductor, which may or may not have a conductor screen applied thereto, to form the core dielectric; applying an intermediate layer of insulating material selected from said group of insulating materials to the outer surface of the core dielectric in such a way that the intermediate layer bonds to or can be subsequently bonded to the core dielectric; and applying a layer of conductive or semi-conductive material selected from the group consisting of conductive and semi-conductive rubber and plastics materials to the outer surfaces of the intermediate layer in such a way that the dielectric screen so formed bonds to, or can be subsequently bonded to, the intermediate layer, the strengths of the bonds between the intermediate layer and the core dielectric and between the intermediate layer and the dielectric screen being substantially greater than the cohesive strength of the intermediate layer at least in a circumferentially continuous zone of the layer, and the intermediate layer having, in the final product, a cohesive strength less than the cohesive strengths of the core dielectric and of the dielectric screen.

15. A method as claimed in claim 14 in which the strengths of the bonds between the intermediate layer and the core dielectric and between the intermediate layer and the dielectric screen are substantially greater than the cohesive strength of the intermediate layer throughout the layer.

16. A method as claimed in claim 14 in which the intermediate layer has, in the final product, a cohesive strength in the range from about 5% to about 70% of the cohesive strength of whichever of the dielectric and the dielectric screen is the weaker.

17. A method as claimed in claim 14 in which the intermediate layer has, in the final product, a cohesive strength in the range from about 5% to about 50% of the cohesive strength of whichever of the dielectric screen is the weaker.

18. A method of forming a cable core comprising extruding a layer of an insulating material selected from the group of insulating materials consisting of rubber and plastics materials onto a travelling conductor, which may or may not have a conductor screen applied thereto, to form the core dielectric; extruding an intermediate layer of insulating material selected from said group of insulating materials onto the outer surface of the core dielectric in such a way that the intermediate layer bonds to the core dielectric; and extruding a layer of conductive or semi-conductive material selected from the group consisting of conductive and semi-conductive rubber and plastics materials onto the outer surfaces of the intermediate layer in such a way that the dielectric screen so formed bonds to the intermediate layer, the strengths of the bonds between the intermediate layer and the core dielectric and between the intermediate layer and the dielectric screen being substantially greater than the cohesive strength of the intermediate layer at least in a circumferentially continuous zone of the layer and the intermediate layer having, in the final product, a cohesive strength less than the cohesive strengths of the core dielectric and of the dielectric screen.

19. A method as claimed in claim 18 in which the conductor screen and core dielectric are extruded simultaneously in the same extrusion head.

20. A method as claimed in claim 18 in which the intermediate layer and the dielectric screen respectively are extruded while the core dielectric and the intermediate layer are still hot by a simultaneous in-line extrusion process.

21. A method of forming a cable core comprising extruding a conductor screen onto a travelling conductor; extruding a layer of an insulating material selected from the group of insulating materials consisting of rubber and plastics materials onto the said conductor screen to form the core dielectric; extruding an intermediate layer of insulating material selected from said group of insulating materials onto the outer surface of the core dielectric in such a way that the intermediate layer bonds to the core dielectric; and extruding a layer of conductive or semi-conductive material selected from the group consisting of conductive and semi-conductive rubber and plastics materials onto the outer surfaces of the intermediate layer in such a way that the dielectric screen so formed bonds to the intermediate layer, the strengths of the bonds between the intermediate layer and the core dielectric and between the intermediate layer and the dielectric screen being substantially greater than the cohesive strength of the intermediate layer at least in a circumferentially continuous zone of the layer and the intermediate layer having, in the final product, a cohesive strength less than the cohesive strengths of the core dielectric and of the dielectric screen.

* * * * *